United States Patent [19]

Carnahan et al.

[11] Patent Number: 4,654,661

[45] Date of Patent: Mar. 31, 1987

[54] TWO FAULT TOLERANT TRANSMITTER ACTIVATOR

[75] Inventors: Samuel U. Carnahan, Hanover; Arthur G. Buckingham, Baltimore, both of Md.

[73] Assignee: The United States of America as represented by the Secretary of the Air Force, Washington, D.C.

[21] Appl. No.: 822,946

[22] Filed: Jan. 27, 1986

Related U.S. Application Data

[63] Continuation of Ser. No. 480,170, Mar. 29, 1983, abandoned.

[51] Int. Cl.[4] ..... G08C 19/00

[52] U.S. Cl. ..... 340/825.57; 340/825.66; 375/69

[58] Field of Search ..... 375/69, 71, 68, 70; 455/92, 117, 127; 307/40, 41, 139; 340/825.57, 825.69, 825.01, 825.75, 825.76, 825.44, 825.65–825.68

[56] References Cited

U.S. PATENT DOCUMENTS

| | | | |
|---|---|---|---|
| 2,237,101 | 4/1941 | Hahndorf | 178/66 |
| 2,593,504 | 4/1952 | Varela | 320/1 |
| 2,607,895 | 8/1952 | Bradley et al. | 250/36 |
| 3,328,696 | 6/1967 | Schunemann | 455/117 |
| 3,581,075 | 5/1971 | Mattsson et al. | 235/153 |
| 3,757,223 | 9/1973 | Hazen | 325/160 |
| 3,794,920 | 2/1974 | Darrow | 325/105 |
| 4,004,228 | 1/1977 | Mullett | 325/113 |
| 4,005,428 | 1/1977 | Graham | 343/228 |
| 4,162,486 | 7/1979 | Wyler | 340/310 A |
| 4,305,060 | 12/1981 | Apple et al. | 340/825.65 |

*Primary Examiner*—Ulysses Weldon

*Attorney, Agent, or Firm*—Richard J. Donahue; Donald J. Singer

[57] ABSTRACT

Apparatus for inhibiting transmissions from a remotely operated sensor system until its transmitter has been found to be free of two specific operative faults.

1 Claim, 2 Drawing Figures

TWO FAULT TOLERANT TRANSMITTER ACTIVATOR

STATEMENT OF GOVERNMENT INTEREST

The invention described herein may be manufactured and used by or for the Government for governmental purposes without the payment of any royalty thereon.

This application is a continuation of application Ser. No. 480,170, filed Mar. 29, 1983 now abandoned.

BACKGROUND OF THE INVENTION

The present invention relates to control apparatus for remotely activating the transmitter of an impact sensor system. More particularly, it concerns circuitry which prevents inadvertent emissions from a remotely activated transmitter until it has been commanded into two successive operative modes and has also received two reset commands, as will be explained in detail below.

Signal transmission systems are often used in remote locations to monitor various phenomena occurring in the vicinity of the system, such as motion, temperature and pressure changes and the like. One such application concerns the monitoring of a sensor adapted to detect stresses, strains and impacts upon a satellite carried into space and launched into orbit by a manned spacecraft, such as the space shuttle.

It is important for safety reasons that the transmitter associated with such an impact sensor system not be inadvertently activated while traveling as cargo in the space shuttle. After the satellite has been launched into orbit, a transmitter turn-on command is sent to the satellite by the spacecraft. The initial operative mode in which the impact sensor system is placed however, is completely random and if the command happens to place the impact sensor to an in-flight test mode or alarm mode, the transmitter would broadcast. Therefore a first fault that could possibly occur which could cause the impact sensor transmitter to broadcast is the presence of a false or unintended spacecraft command. A second fault that could possibly occur which would also cause the transmitter to erroneously broadcast concerns a defective component in the logic circuitry to the transmitter power switch or a defect in the power switch itself.

It is accordingly an object of the present invention to provide a two fault tolerant transmitter activator.

It is a more specific object of the invention to provide means for inhibiting transmissions from a remotely activated impact sensing transmitter until the transmitter has been found to be free of specific operative faults.

SUMMARY OF THE INVENTION

According to this invention, a two fault tolerant transmitter activator for an impact sensor system is disclosed which prevents the generation of transmitter keying pulses until the impact sensor transmitter has been commanded into two successive command states as verified by two operations of a three second clock, and prevents the switching of power to the transmitter booster amplifier until the impact sensor transmitter has been commanded into the reset mode and remains there for two operations of a three second clock.

BRIEF DESCRIPTION OF THE DRAWINGS

These and other objects and advantages of the present invention will become more apparent upon reading the following specification and by reference to the drawings in which.

DETAILED DESCRIPTION OF THE PREFERRED EMBODIMENT

Figure 1:
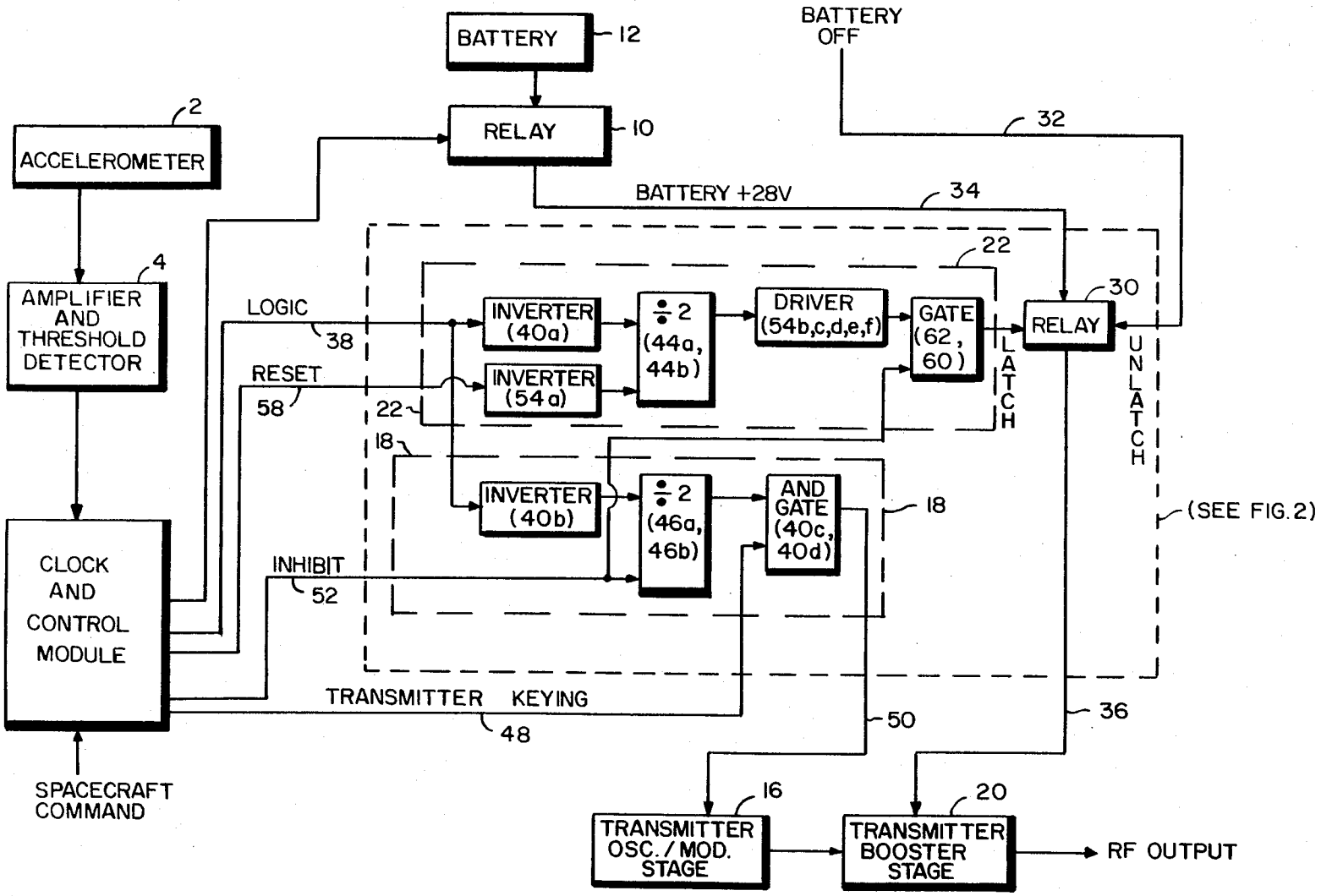
FIG. 1 is a block diagram showing the major components of an impact sensor system having the two fault tolerant capability of the present invention.

Referring now to FIG. 1 of the drawings, the impact sensor system includes an accelerometer 2 having associated therewith an amplifier and threshold detector 4. Output signals from amplifier 4 are in turn coupled to a clock and control module 6 which also receives commands transmitted thereto by the spacecraft. The clock and control module 6 comprises a clock oscillator and digital logic circuitry of conventional design.

In order for the impact sensor system to operate following a launch into orbit, a command from the spacecraft closes relay 10 and permits power from battery 12 to flow to the booster stage 20 if relay 30 is closed. As previously mentioned the initial mode to which the impact sensor system is commanded is completely random and could in certain instances, result in unwanted signal transmissions. As shown in the block diagram, however, the coupling of transmitter switching commands from the control module 6 to the transmitter oscillator/modulator stages 16 is now interrupted by a decision circuit 18. The decision circuit 18 prevents a single command from the spacecraft from causing the impact sensor system transmitter to broadcast. The interruption at the decision circuit 18 will continue until the impact sensor system has been commanded to change operative modes or states at least twice. The preferred implementation of decision circuit 18 is shown and discussed later herein with reference to FIG. 2 of the drawings, and includes the interconnected components 40 *b*, 40*c*, 40*d*, 46*a* and 46*b*.

After relay 10 is closed, a second fault could occur which would make the transmitter broadcast. Such a fault might include a component in either the logic circuitry to the transmitter power switch or the power switch itself. To prevent this second type of fault from causing the transmitter to inadvertently broadcast, the power from battery 12 to the transmitter booster stage 20 is now interrupted by a decision circuit 22 until the impact sensor has been commanded into the reset mode at least twice. The preferred implementation of decision circuit 22 is shown and discussed later herein with respect to FIG. 2 of the drawings, and includes the interconnected components 40*a*, 44*a*, 44*b*, 54*a–f*, 60, 62, 64, 68 and 70.

Figure 2:
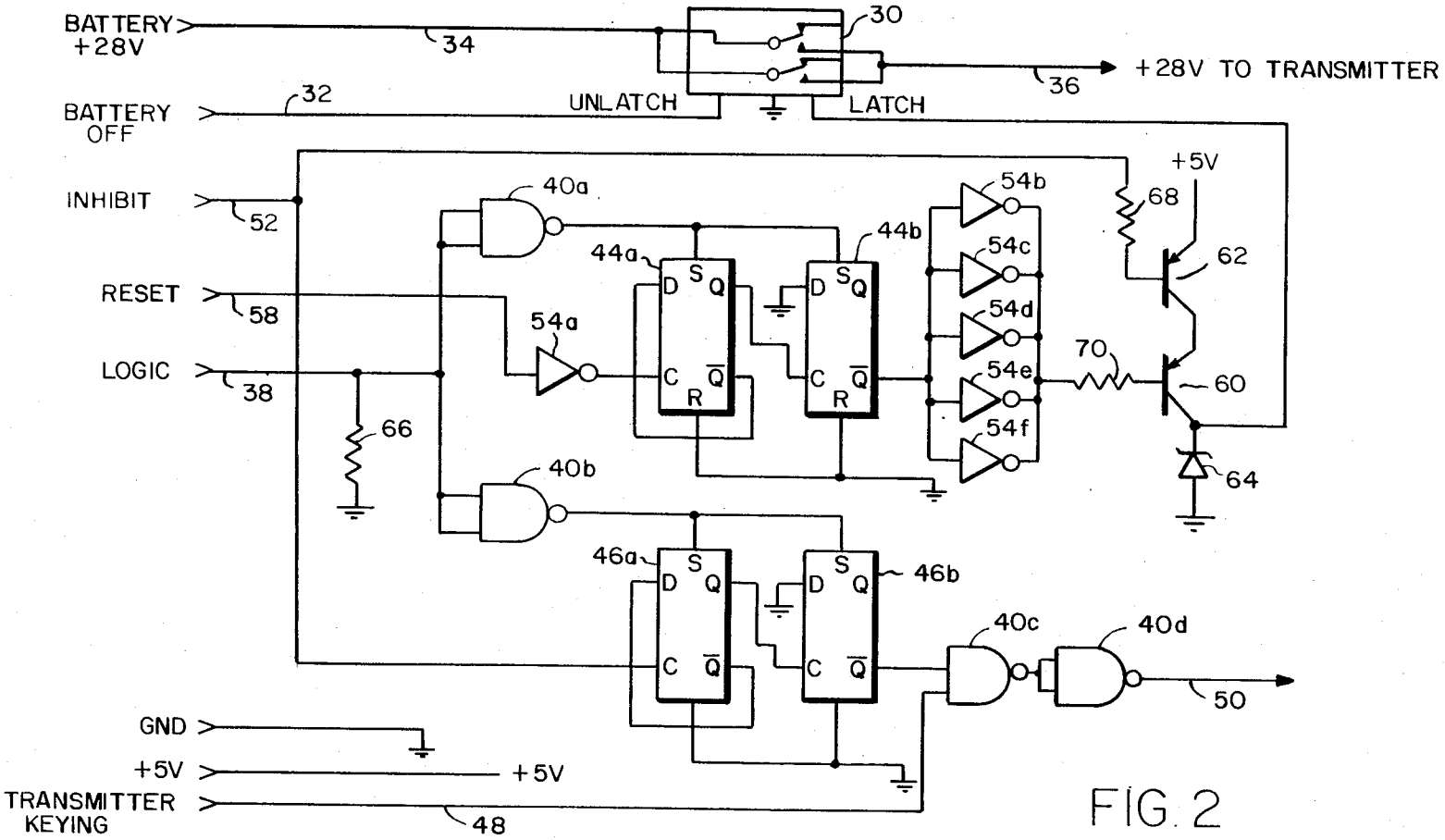
FIG. 2 is a circuit diagram showing in more detail the interconnections of the device of the present invention with the components of the system of FIG. 1.

FIG. 2 illustrates the circuit design of the two fault tolerant circuit. During prelaunch checkout, the impact sensor system is placed in the battery off condition by a signal applied to a latching relay 30 via lead 32. This signal opens relay 30 breaking the 28 volt power line 34 to the transmitter booster stage via lead 36. At this time the logic signal applied to lead 38 goes to ground, i.e. zero reference potential. The ground signal is applied to the inputs of inverter stages 40*a* and 40*b* causing the D-type flip-flops 44*a*, 44*b*, 46*a* and 46*b* to assume their "set" states. Transmitter keying via signals supplied on lead 48 is prevented by (1) the break in the 28 volt DC supply to the transmitter and (2) the inclusion of NAND gate 40*c* in the transmitter keying lead 48.

Transmitter operation is thus prevented until a specific sequence of events takes place.

On the first spacecraft command, the logic signal on lead 38 switches from zero volts to +5 volts DC. This enables the D-type flip flops 44*a*, 44*b*, 46*a*, 46*b* and at the end of a three second inhibit interval lead 52 goes high and changes the state of flip-flop 46*a*. (46*a*-Q goes low) A second command will cause flip flop 46*b* to go high and enable the NAND gates 40*c* and 40*d*. A transmitter keying signal on lead 48 will now appear on lead 50 as it normally would have appeared without the two fault transmitter activating circuitry.

Any two commands spaced greater than three seconds apart will enable the transmitter keying signal, but a specific set of commands is required to close relay 30. On any first command, 5 volts is applied to the logic circuitry. Inverter 54*a* causes the turn on of the system to provide a pulse having a negative leading edge to flip flop 44*a* so that initial activation of the impact sensor system is not included as a count. The reset signal on lead 58 is normally high and will go low only if the impact sensor system has been placed in its reset mode and remains there for a three second inhibit time. For flip-flop 44*b* to go high, the impact sensor system has to be placed in the reset mode for three seconds each of two separate times. Any amount of spacecraft command switching can occur without closing relay 30 as long as the reset mode has not been exercised two times for three seconds each. Five buffer inverters 54*b*–54*f* inclusive are paralleled to insure sufficient current to drive an output transistor 60. A second transistor 62 in series with the transistor 60 is biased off except for three seconds after any spacecraft command. This prevents constant current drain through the relay 30 latching coil. When transistors 60 and 62 are energized, power from the battery is supplied to the transmitter via lead 34, relay 30 and lead 36.

The invention described above can be constructed of standard commercially available components. Thus, inverting gates 40*a*, 40*b*, 40*c* and 40*d* can be purchased from RCA Corporation as their QUAD NAND GATE unit 4011. Similarly, flip-flops 44*a* and 44*b*, and flip-flops 46*a* and 46*b* may each be formed of RCA Dual D type flip-flop logic units 4013. Output transistors 60 and 62 may be type 2N2907A devices manufactured by Texas Instruments Inc. and others. Gating circuits 54*a*–*f* inclusive may be RCA hex inverter buffer units 4049. Latching relay 30 may be purchased from Teledyne Corporation. Zener diode 64 is provided to limit the reverse voltage applied at the collector of transistor 60. This may be 6.3 volt device bearing the designation 1N753 manufactured by several companies. Resistor 66 may have a value of 100K ohms while current limiting resistors 68 and 70 in series with the base leads of transistors 62 and 60 respectively are each 2,000 ohms.

It is to be noted that although there have been described the fundamental and unique features of my invention as applied to a preferred embodiment, various other embodiments, variations, adaptations, substitutions, additions, omissions, and the like may occur to, and can be made by, those of ordinary skill in the art, without departing from the spirit of the invention.

What is claimed is:

1. Apparatus for coupling power and keying signals comprising:

a power input terminal, a power output terminal, a keying signal input terminal, a keying signal output terminal and first and second control signal terminals;

first switching means coupled between said power input terminal and said power output terminal comprising a latching relay having a pair of switching contacts and a latching signal terminal, first gating means having first and second inputs and an output, and a first pair of serially-connected bistable flip/flop stages having an input and an output, said output of said first gating means being coupled to said latching signal terminal, said first input of said first gating means being coupled to said output of said first pair of bistable flip/flop stages, said input of said first pair of bistable flip/flop stages being coupled to said first control signal terminal, and said second input of said first gating means being coupled to said second control signal terminal; and second switching means comprising a second pair of serially-connected bistable flip/flop stages having an input and an output, said input of said second pair of bistable flip/flop stages being coupled to said second control signal terminal, second gating means having first and second inputs and an output, said output of said second pair of bistable flip/flop stages being coupled to said first input of said second gating means, said second input of said second gating means being coupled to said keying signal input terminal and said output of said second gating means being coupled to said keying signal output terminal.

* * * * *